US006185769B1

(12) United States Patent
Larisey, Jr. et al.

(10) Patent No.: US 6,185,769 B1
(45) Date of Patent: Feb. 13, 2001

(54) RESIDENT TRANSFER CHAIR

(75) Inventors: William S. Larisey, Jr., Summerville, SC (US); Charles M. Stout, Cincinnati; Brian L. Crosley, Harrison, both of OH (US)

(73) Assignee: Hill-Rom, Inc., Batesville, IN (US)

( * ) Notice: Under 35 U.S.C. 154(b), the term of this patent shall be extended for 0 days.

(21) Appl. No.: 09/420,078

(22) Filed: Oct. 18, 1999

Related U.S. Application Data

(62) Division of application No. 09/174,702, filed on Oct. 19, 1998.

(51) Int. Cl.[7] ..... A47C 17/86
(52) U.S. Cl. ..... 5/648; 5/661; 5/618; 297/423.36
(58) Field of Search ..... 5/618, 648, 624, 5/658, 661; 297/423.38, 423.36, 423.3, 423.26

(56) References Cited

U.S. PATENT DOCUMENTS

| | | | |
|---|---|---|---|
| 93,660 | 8/1869 | Theaker . | |
| 156,004 | * 10/1874 | Wayland | 297/423.3 |
| 346,246 | 7/1886 | Uhde . | |
| 825,984 | 7/1906 | Schmersahl . | |
| 1,398,203 | 11/1921 | Schmidt . | |
| 2,308,592 | 1/1943 | Drexler et al. . | |
| 2,377,649 | 6/1945 | Quinney . | |
| 2,766,463 | 10/1956 | Bendersky . | |
| 3,038,174 | 6/1962 | Brown et al. . | |
| 3,053,568 | 9/1962 | Miller . | |
| 3,096,121 | 7/1963 | Knabusch et al. . | |
| 3,099,487 | 7/1963 | Knabusch et al. . | |
| 3,112,001 | 11/1963 | Wise . | |

(List continued on next page.)

FOREIGN PATENT DOCUMENTS 58-63575 4/1983 (JP) .

OTHER PUBLICATIONS

Ortho–Biotic® Seating Product Brochure, "Table–Mate Posture–Glide™ Loungers", Lumex, 1987, four pages.
Ortho–Biotic® Seating Product Brochure, "3 Position Recliner—Model No. 574", Lumex, 1986, four pages.
Thayercare© Product Brochure, "5235 Recliner", Thayer Coggin Institutional, date unknown, two pages.
Patient Lounger Product Brochure, "4 Position Recliner", T.B.S., date unknown, two pages.

(List continued on next page.)

*Primary Examiner*—Anthony Knight
*Assistant Examiner*—James M Hewitt
(74) *Attorney, Agent, or Firm*—Barnes & Thornburg

(57) ABSTRACT

A chair apparatus includes a base frame, an intermediate frame coupled to the base frame, and a resident support frame including a back section, a seat section, and a leg section pivotably coupled to the base frame and the intermediate frame by a plurality of links to permit the support frame to move from a chair position to a flat position. The apparatus also includes a cylinder and piston pivotably coupled between the intermediate frame and the base frame to hold the intermediate frame in a selected position relative to the base frame, a first actuator coupled to the cylinder to release the piston and permit tilting movement of the intermediate frame relative to the base frame to recline the support frame relative to the base frame, a spring assist coupled between the intermediate frame and the support frame, a locking mechanism coupled between the base frame and the support frame to hold the support frame in a desired position relative to the base frame, and a second actuator coupled to the locking mechanism to release the locking mechanism and permit movement of the support frame relative to the base.

20 Claims, 7 Drawing Sheets

U.S. PATENT DOCUMENTS

| | | | | |
|---|---|---|---|---|
| 3,147,039 | | 9/1964 | Smith et al. . | |
| 3,210,779 | | 10/1965 | Herbold . | |
| 3,217,340 | | 11/1965 | Durr . | |
| 3,220,022 | * | 11/1965 | Nelson | 5/618 |
| 3,235,304 | | 2/1966 | Glass . | |
| 3,235,307 | | 2/1966 | Knabusch et al. . | |
| 3,304,116 | | 2/1967 | Stryker . | |
| 3,325,210 | | 6/1967 | Knabusch et al. . | |
| 3,336,606 | | 8/1967 | Beitzel . | |
| 3,357,739 | | 12/1967 | Knabusch et al. . | |
| 3,406,772 | | 10/1968 | Ahrent et al. . | |
| 3,484,132 | | 12/1969 | Biagi . | |
| 3,484,133 | | 12/1969 | White et al. . | |
| 3,695,701 | | 10/1972 | Knabusch et al. . | |
| 3,711,876 | | 1/1973 | Kirkland et al. . | |
| 3,793,652 | | 2/1974 | Linehan et al. . | |
| 3,801,122 | | 4/1974 | Shoemaker et al. . | |
| 3,848,924 | | 11/1974 | Shoemaker et al. . | |
| 3,858,938 | * | 1/1975 | Kristensson et al. | 297/423.19 |
| 3,965,500 | | 6/1976 | Stein, Jr. . | |
| 4,039,223 | * | 8/1977 | Kristensson | 297/423.36 X |
| 4,076,304 | * | 2/1978 | Deucher | 297/423.38 X |
| 4,092,041 | | 5/1978 | Landry et al. . | |
| 4,119,342 | | 10/1978 | Jones . | |
| 4,153,292 | | 5/1979 | White et al. . | |
| 4,183,109 | | 1/1980 | Howell . | |
| 4,227,269 | | 10/1980 | Johnston . | |
| 4,284,268 | * | 8/1981 | Gauthier | 5/624 |
| 4,367,895 | | 1/1983 | Pacitti et al. . | |
| 4,381,571 | | 5/1983 | Elliott . | |
| 4,385,410 | | 5/1983 | Elliott et al. . | |
| 4,407,030 | | 10/1983 | Elliott . | |
| 4,451,945 | | 6/1984 | Heinz et al. . | |
| 4,453,732 | | 6/1984 | Assanah et al. . | |
| 4,555,121 | | 11/1985 | Lockard et al. . | |
| 4,592,104 | | 6/1986 | Foster et al. . | |
| 4,629,242 | | 12/1986 | Schrager . | |
| 4,632,450 | | 12/1986 | Holdt . | |
| 4,639,954 | | 2/1987 | Speed . | |
| 4,751,754 | | 6/1988 | Bailey et al. . | |
| 4,790,599 | | 12/1988 | Goldman . | |
| 4,862,529 | | 9/1989 | Peck . | |
| 4,894,876 | | 1/1990 | Fenwick . | |
| 4,918,766 | | 4/1990 | Leonaggeo, Jr. . | |
| 4,949,410 | | 8/1990 | Failor et al. . | |
| 4,974,905 | | 12/1990 | Davis . | |
| 5,011,220 | | 4/1991 | LaPointe . | |
| 5,033,793 | * | 7/1991 | Quintile | 297/423.33 |
| 5,072,463 | | 12/1991 | Willis . | |
| 5,074,000 | | 12/1991 | Soltani et al. . | |
| 5,148,562 | | 9/1992 | Borders et al. . | |
| 5,195,803 | | 3/1993 | Quintile . | |
| 5,203,610 | | 4/1993 | Miller . | |
| 5,230,113 | | 7/1993 | Foster et al. . | |
| 5,279,010 | | 1/1994 | Ferrand et al. . | |
| 5,282,395 | | 2/1994 | LaPointe et al. . | |
| 5,288,126 | | 2/1994 | Saul et al. . | |
| 5,294,141 | | 3/1994 | Mentessi et al. . | |
| 5,398,357 | | 3/1995 | Foster . | |
| 5,577,279 | | 11/1996 | Foster et al. . | |

OTHER PUBLICATIONS

Invacare®, Innovation In Health Care™ Product Brochure, "Comfort+Plus™, Seating System", date unknown, four pages.

Treatment Chairs Pristo™ Product Brochure, Nemschoff, date unknown, four pages.

La–Z–Boy® Contract Product Brochure, "Health Care Products", date unknown, four pages.

Anatome Une Revolution, Le Couviour Product Brochure, Group Hill–Rom®, date unknown, six pages.

* cited by examiner

RESIDENT TRANSFER CHAIR

This is a divisional of application Ser. No. 09/174,702, filed Oct. 19, 1998.

BACKGROUND AND SUMMARY OF THE INVENTION

The present invention relates to a resident transfer chair. More particularly, the present invention relates to a chair designed for a long-term care environment which provides improved seating comfort and positioning for residents during extended seating and which facilitates transfer of the residents between the chair and a bed.

When a resident is generally confined to a chair or bed, a caregiver must often manually lift the resident from the bed to the chair or vice versa. The chair of the present invention is configured to move from a chair position to an elevated flat position to facilitate transfer of the resident. A spring assisted linkage mechanism allows for easy conversion from the chair position to the flat position. Movable arms on the chair can be positioned out of the way during seated or flat transfers from the chair to an adjacent bed.

The chair of the present invention includes a contoured back section to provide improved lumbar support and flexibility for different body profiles to allow hours of comfortable seating. The present invention includes flexible webbing support structures between frame members so that the seat can adjust to different body types. A contoured seat prevents sliding out of the front or the sides of the seat. The chair of the present invention also includes a tilt-in-space reclined position and an independently adjustable leg rest to provide therapeutic positioning and promote pressure reduction for residents on the chair.

In the flat position, the chair of the present invention provides bed-to-chair transfer with a zero transfer gap. Transfer is accomplished without the use of slings, batteries, or other parts. The arms on the chair are movable and the tilt position of the chair is infinitely adjustable to allow the chair to be positioned properly for easy and comfortable resident transfers from a seated position.

According to one aspect of the present invention, a chair apparatus includes a base frame, an intermediate frame coupled to the base frame, and a resident support frame including a back section, a seat section, and a leg section pivotably coupled to the base frame and the intermediate frame by a plurality of links to permit the support frame to move from a chair position to a flat position. The apparatus also includes a cylinder and piston pivotably coupled between the intermediate frame and the base frame to hold the intermediate frame in a selected position relative to the base frame, a first actuator coupled to the cylinder to release the piston and permit tilting movement of the intermediate frame relative to the base frame to recline the support frame relative to the base frame, a spring assist coupled between the intermediate frame and the support frame, a locking mechanism coupled between the base frame and the support frame to hold the support frame in a desired position relative to the base frame, and a second actuator coupled to the locking mechanism to release the locking mechanism and permit movement of the support frame relative to the base.

In the illustrated embodiment, the back section is pivotably coupled to the intermediate frame about a pivot axis. The back section includes a top handle spaced apart from the pivot axis by a predetermined distance to facilitate movement of the chair from the chair position to the flat position. The spring assist has a predetermined force so that a maximum force of 36 pounds is required on the handle to lift a 200 pound resident on the chair from the chair position to the flat position.

In the illustrated embodiment, a push handle is coupled to the back section. The first actuator is coupled to the push handle, and the second actuator is coupled to the top handle.

Also in the illustrated embodiment, the locking mechanism includes a mech-lock pivotably coupled to the base frame. The mech-lock is slidably coupled to a rod, and the rod being pivotably coupled to the support frame.

According to another aspect of the present invention, an arm support apparatus is provided for a chair including a frame section. The arm support apparatus includes a support coupled to the frame section of the chair, an actuator coupled to the support, at least one pin extending outwardly from the actuator, a spring coupled between the actuator and the support to bias the actuator relative to the support, and a cylindrical portion rotatably coupled to the support. The cylindrical portion is formed to include a plurality of notches configured to receive the at least one pin to hold the cylindrical portion in a predetermined position relative to the support. The apparatus also includes an arm rest rigidly coupled to the cylindrical portion.

In the illustrated embodiment, the support is formed to include a notched section configured to receive the pin of the actuator to prevent the cylindrical portion from rotating relative to the support. The cylindrical portion illustratively includes four notches, each notch being spaced apart by 90° from an adjacent notch. In the illustrated embodiment, first and second spaced apart pins are coupled to the actuator. The pins are configured to enter spaced apart notches on the cylindrical portion. Illustratively, the pins are spaced apart by an angle of 180° so that the pins are configured to enter diametrically opposed notches formed on the cylindrical portion. A knob coupled to an end of the actuator.

Also in the illustrated embodiment, the support is a cylindrical member including an interior region. The actuator includes a threaded portion located within the interior region of the support. The spring is configured to engage a flange formed in the interior region of the support, and the spring also being configured to engage a nut coupled to the threaded portion of the actuator so that the spring applies an inwardly directed biasing force to the actuator.

According to yet another aspect of the present invention, an adjustable foot prop apparatus is provided for a leg section of a chair. The apparatus includes a positioning member coupled to the leg section. The positioning member is configured to define a plurality of spaced apart stops. The apparatus also includes a support movably coupled to the leg section, a foot prop coupled to the support, and a control tube coupled to the support. The control tube has a stop configured to engage one of the plurality of stops on the positioning member. The apparatus further includes an actuator configured to permit movement of the control tube and the stop away from the stop on the positioning member so that the support and the foot prop can move relative to the leg section, and at least one spring configured to bias the control tube toward the positioning member so that the stop on the control tube engages one of the stops of the positioning member when the actuator is released.

In the illustrated embodiment, the positioning member includes a support member coupled to the leg section and a spring located on the support member. The spring is configured to define the plurality of spaced apart stops.

The illustrated support includes a fixed support having a receptacle coupled to the leg section of the chair and a movable support located in the receptacle. The foot prop is coupled to the movable support.

Illustratively, the support includes first and second fixed supports coupled to the leg section. Each of the fixed supports has first and second spaced apart receptacles. The support also includes first and second movable supports located within the receptacles of the first and second fixed supports, respectively. The foot prop is coupled to the first and second movable supports. The control tube is slidably coupled to the first and second movable supports. A first spring is coupled to the control tube and configured to engage the first movable support. A second spring is coupled to the control tube and configured to engage the second movable support to bias the control tube so that the stop on the control tube normally engages one of the plurality of stops on the positioning member. First and second actuators are coupled to opposite ends of the control tube so that the control tube can be moved to release the support from the positioning member from either side of the leg section.

According to a further aspect of the present invention, a tilt lock apparatus is provided for holding a leg section of a chair at a desired position relative to a seat section of a chair. The apparatus includes a first link pivotably coupled to the seat section, a second link movably coupled to the first link, and a latch pivotably coupled to the second link. The latch is formed to include a plurality of teeth spaced apart along a circumferential edge of the latch. The latch also is rigidly coupled to the leg section of the chair. The apparatus also includes a lever pivotably coupled to the second link adjacent the latch. The lever includes an edge portion configured to engage one of the plurality of teeth to hold the latch and the leg section in a predetermined position relative to the lever. The lever is pivotable relative to the second link between a first position in which the edge is aligned to engage the plurality of teeth and hold the leg section in the predetermined position and a second disengaged position to permit the leg section to return to a downwardly pivoted position due to gravity.

In the illustrated embodiment, the lever includes an actuator tab spaced apart from a pivot axis of the lever so that a caregiver can rotate the lever to move the lever to its second disengaged position. A torsion spring is illustratively coupled to the lever. The torsion spring is configured to move the lever to its first position when the actuator is released.

Also in the illustrated embodiment, the chair is movable from a chair position to a flat position. The first link includes a strike plate, and the lever includes a tab. The first link is configured to move relative to the second link so that the strike plate engages the tab of the lever to move the lever to its second disengaged position when the chair is moved to the flat position. The lever is also formed to include a second tab to limit movement of the lever relative to the latch. In the illustrated embodiment, the first link is a first tube and the second link is a second tube slidably received within the first tube.

Additional features of the invention will become apparent to those skilled in the art upon consideration of the following detailed description of the illustrated embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
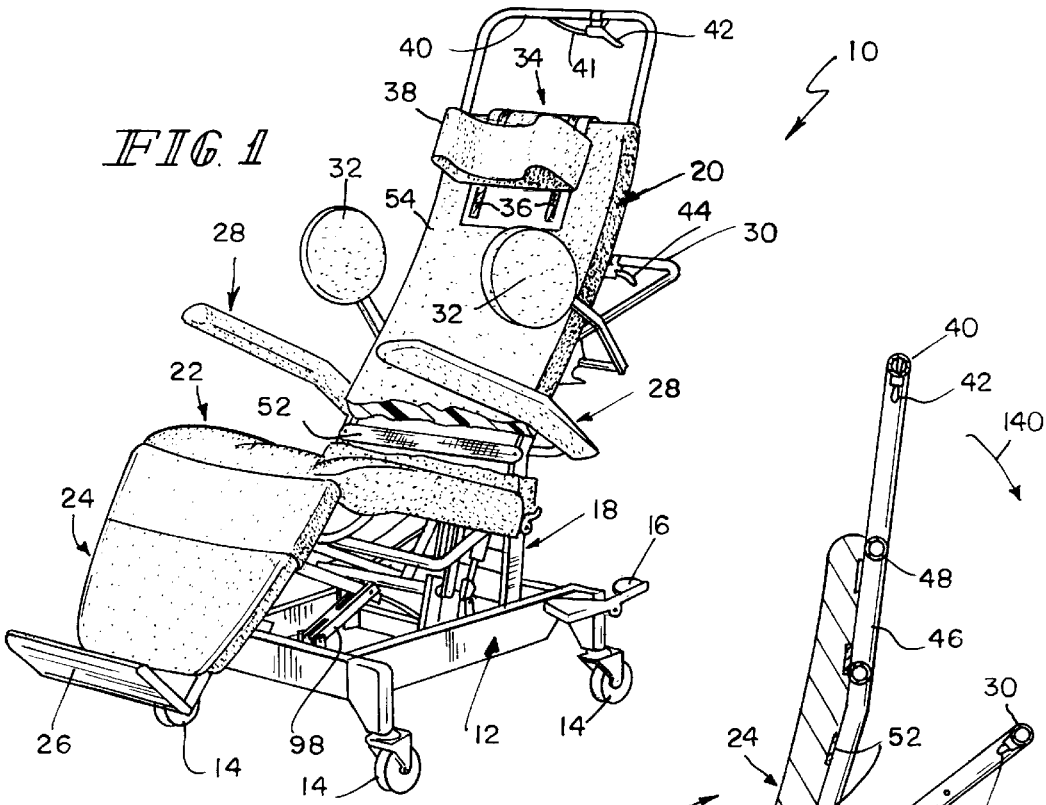
FIG. 1 is a perspective view of a resident transfer chair of the present invention.

Referring now to the drawings, FIG. 1 illustrates a resident transfer chair 10 of the present invention. The chair 10 includes a base frame 12 having four casters 14 coupled to the four corners. A central lock and steer mechanism 16 for the casters 14 is also coupled to the base frame 12. The chair 10 also includes an intermediate frame 18 coupled to the base frame 12 as described below. The chair 10 further includes a back section 20, a seat section 22, and a leg section 24 coupled to both the base frame 12 and the intermediate frame 18. An adjustable foot prop 26 is coupled to the leg section 24. Padded movable arms 28 are coupled to the back section 20. A steering bar 30 is also coupled to the back section 20 for transporting the chair 10. A drainage bag hanger 31 is coupled to the intermediate frame 18. Optional side supports 32 may also be coupled to the back frame section 20. In addition, a head rest, 34 having Velcro portions 36 and a contoured head section 38 may be coupled to the back section 20. The position of the head section 38 may be adjusted on the Velcro portions 36.

A top bar or handle 40 of back section 20 extends above the padded resident support portion 54 of the chair 10 to facilitate movement of the chair 10 from the chair position to the flat position as discussed in detail below. A release mechanism actuator 42 is coupled to handle 40 to permit movement of the chair 10 from the chair position shown in FIG. 2 to the flat position shown in FIG. 4. Another release mechanism actuator 44 is coupled to steering bar 30 to permit movement of the chair 10 from the chair position shown in FIG. 2 to the tilt-in-space, reclined position shown in FIG. 3.

Figure 2:
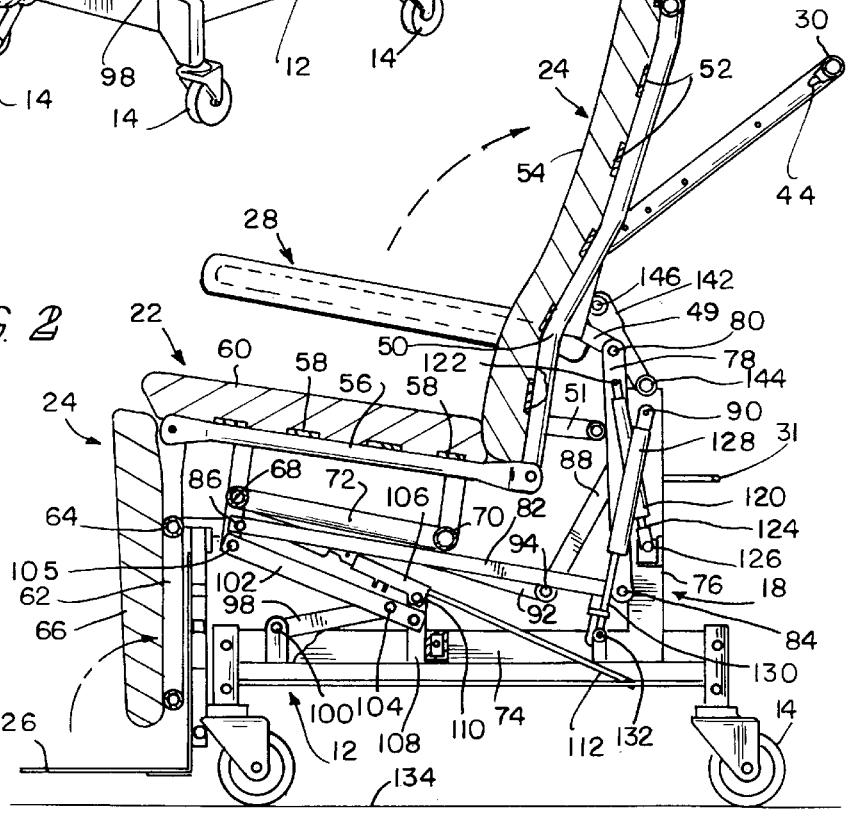
FIG. 2 is a sectional view taken through the chair of FIG. 1 illustrating linkages for controlling movement of the chair, with the chair in a chair position.
Figure 3:
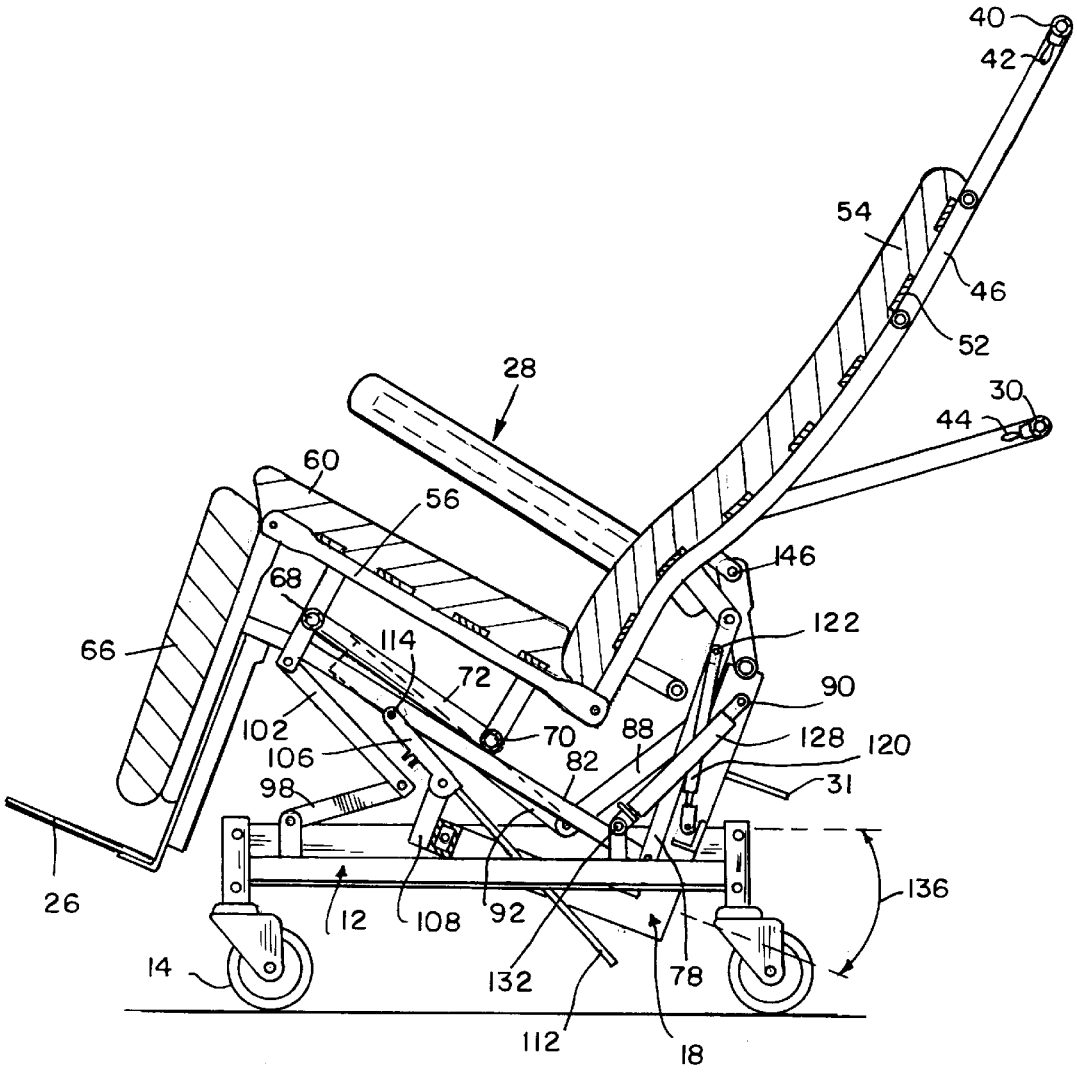
FIG. 3 is a sectional view illustrating the chair moved to a tilt-in-space, reclined position.
Figure 4:
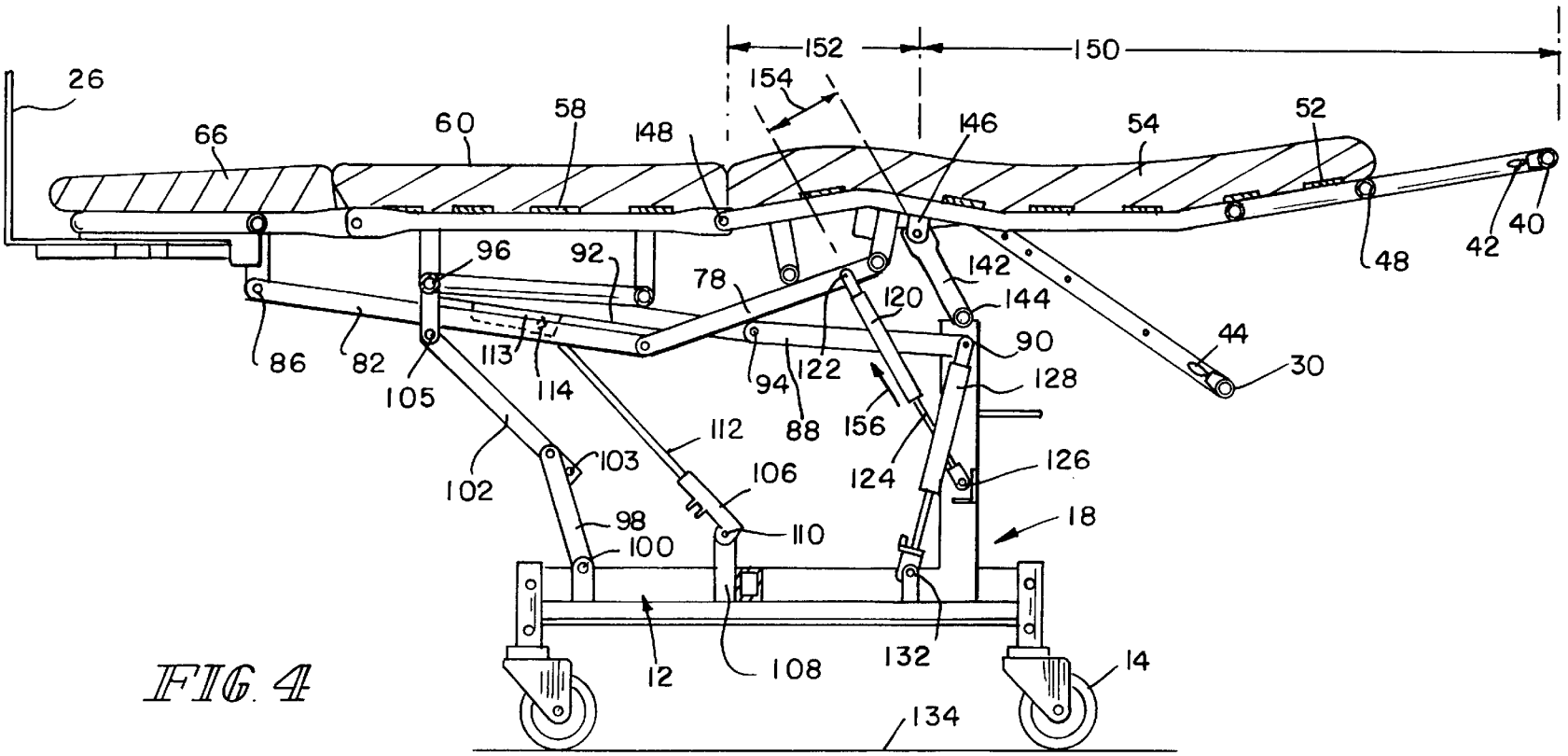
FIG. 4 is a sectional view illustrating the chair moved to an elevated, flat position.
Figure 5:
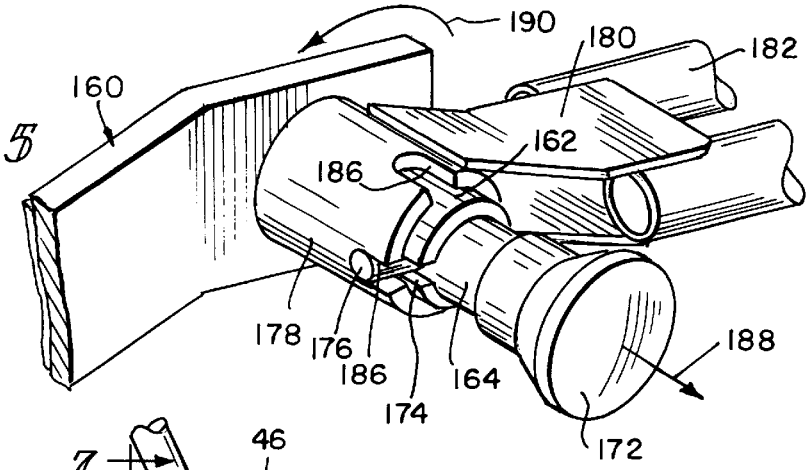
FIGS. 5–8 illustrate a locking mechanism for positioning arms on the chair at desired positions.
Figure 6:
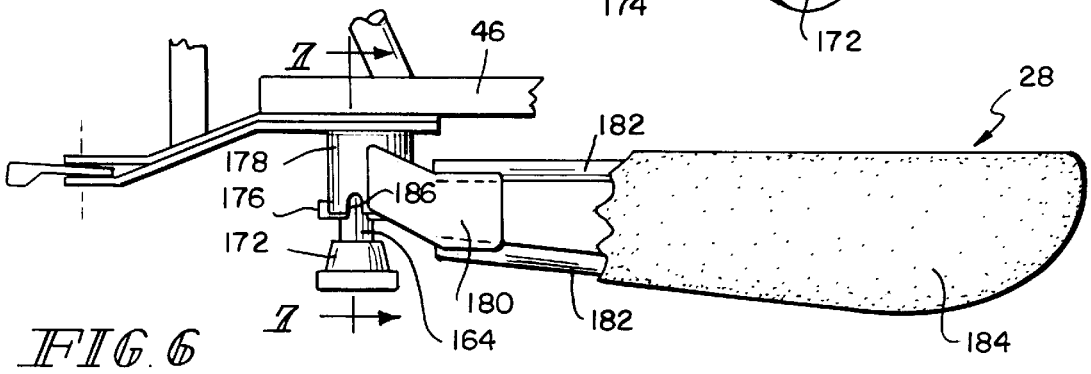
Figure 7:
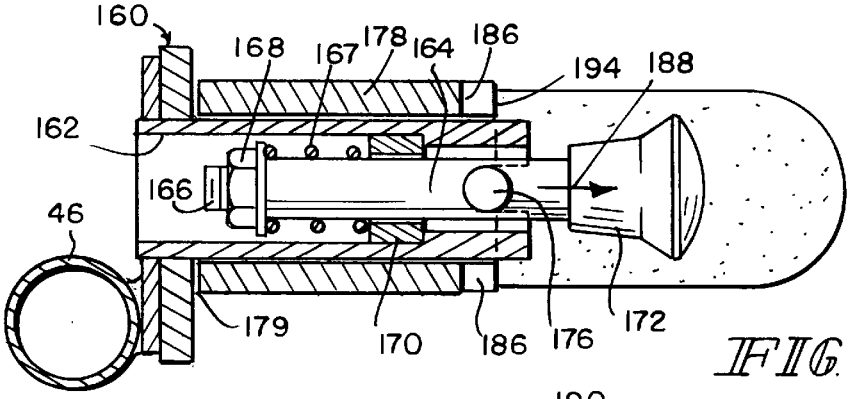

As best shown in FIGS. 2–4, the back section 20 includes an outer U-shaped tube frame member 46 having an upper cross tube 48, a middle cross tube 49, and a lower cross tube 51. Frame 46 includes a contoured or curved portion 50 to provide improved lumbar support and flexibility for supporting different body profiles of the resident. Webbing or straps 52 extend between opposite sides of the U-shaped frame 46 to support padded back surface 54. Illustratively, straps 52 have hooks at opposite end which enter apertures formed in the frame 46.

Seat section 22 also includes side frame members 56 and webbing or straps 58 extending between the side frame members 56 for supporting a padded seat section 60. Seat section 22 includes cross tubes 68 and 70 coupled to side frame members 56. Two support tubes 72 extend between tubes 68 and 70 of seat section 22. Leg support section 24 includes an outer generally U-shaped frame 62 and a cross bar 64 which support a padded foot section 66.

Illustratively, padded sections 54, 56 and 66 are coupled together. Padded sections 54, 56, and 60 are coupled to frame sections 46, 56, and 62, respectively, by fasteners such as snaps (not shown).

Intermediate frame 18 includes a first generally horizontal section 74 and a second generally vertical section 76. A pair of link arms 78 are coupled to cross bar 49 of back section 24 by connections 80. Opposite ends of link arms 78 are pivotably coupled to link arm 82 by pivot connection 84. Link arm 82 is pivotably coupled to cross member 64 of leg section 24 by pivot connection 86 as best shown in FIG. 4.

A link arm 88 is pivotably coupled to vertical portion 76 of intermediate frame 18 by pivot connection 90. Link arm 88 is also pivotably coupled to a link arm 92 by pivot connection 94. An opposite end of link arm 92 is pivotably coupled to cross member 68 of seat section 22 by pivot connection 96 as best shown in FIG. 4. A link arm 98 is pivotably coupled to base frame 12 by pivot connection 100. Link arm, 98 is also pivotably coupled to link arm 102 by pivot connection 104. A stop 103 on link arm 102 limits pivotable movement of arms 98 and 102 when stop 103 engages arm 98 as shown in FIG. 4. Link arm 102 is pivotably coupled to cross tube 68 of seat section 22 by pivot connection 105.

A mech-lock 106 is pivotably coupled to a clevis 108 located on horizontal section 74 of the intermediate frame 18 by pivot connection 110. Mech-lock 106 is configured to slidably receive a locking bar 112 in a conventional manner. An end of locking bar 112 is pivotably coupled to a plate 113 coupled to link arm 92 by pivot connection 114 as best shown in FIGS. 3 and 4. A control cable 41 extends between actuator 42 and mech-lock 106. When the actuator 42 is actuated, the mech-lock 106 releases the rod 112 for sliding movement and allows movement of the chair 10 between the chair position and the flat position. When the actuator 42 is released, mech-lock 106 grips the rod 112 tightly to hold the chair 10 in the position it was in when the actuator 42 was released.

A gas assist cylinder 120 is pivotably coupled to link arm 78 by pivot connection 122. Gas assist cylinder 120 includes a movable piston 124 which is pivotably coupled to vertical section 76 of intermediate frame 18 by pivot connection 126. A tilt-in-space cylinder 128 is also pivotably coupled to vertical section 76 of intermediate frame 18 as illustrated at location 90. Cylinder 128 includes a movable piston 130 which is pivotably coupled to base frame 12 at location 132.

In the normal chair configuration shown in FIG. 2, the piston 130 is extended from cylinder 128 so that the horizontal section 74 of intermediate frame 18 is generally parallel to the base frame 12 and to the ground 134. A control cable (not shown) is coupled between actuator 44 and gas cylinder 128. When actuator 44 is actuated, cylinder 128 permits movement of the piston 130. Therefore, the intermediate frame 18 can be pivoted backwardly so that the piston 130 retracts into cylinder 128 to the position shown in FIG. 3. This permits the intermediate frame 18 to pivot to the position shown in FIG. 3. Illustratively, the intermediate frame 18 pivots about 22° relative to the base frame 12 as illustrated by angle 136. Movement of the intermediate frame 18 to the position shown in FIG. 3 causes the back section 20, seat section 22, and leg section 24 of the chair 10 to recline to a tilt-in-space position for therapeutic positioning and promotion of pressure reduction for a resident on the chair. When it is desired to move the chair 10 back to its normal chair position, actuator 44 is actuated and the chair 10 is pivoted upwardly to its FIG. 2 position. The actuator 44 is then released to hold the intermediate frame 18 in the FIG. 2 position.

When actuator 42 is actuated, the chair 10 can be moved to the flat configuration illustrated in FIG. 4. As discussed above, the actuator 42 is coupled to mech-lock 106. When mechlock 106 releases the rod 112, gas assist cylinder 120 assists the caregiver with movement of the chair 10 from the chair position shown in FIG. 2 to the flat position shown in FIG. 4. The caregiver must also pull downwardly on the handle 40 of chair 10 as illustrated by arrow 140 in FIG. 2 to assist movement of the resident from the chair position shown in FIG. 2 to the flat position shown in FIG. 4.

Vertical section 76 of intermediate frame 18 is pivotably coupled to a link arm 142 by pivot connection 144. Link arm 142 is also pivotably coupled to back section 20 by pivot connection 146. Back frame section 46 is pivotably coupled to seat frame members 56 by pivot connections 148. The distance 150 between back pivot 146 and top handle 40 is illustratively about 32.8 inches. The distance between back pivot 146 and seat pivot 148 is illustratively about 10.0 inches. The distance 152 between back pivot 146 and pivot connection 122 of gas assist cylinder 120 is illustratively about 4.2 inches, as illustrated by dimension 154 in FIG. 4. Gas assist cylinder 120 applies an upwardly directed force on link arm 78 in the direction of arrow 156. Illustratively, the cylinder 120 assist force is about 158 lbs. The dimensions of the pivot positions, the angles, and the cylinder assist strength of cylinder 120 are configured so that a maximum pull force required on handle 40 in the direction of arrow 140 to move a 200 pound resident on the chair 10 from the chair position of FIG. 2 to the flat position of FIG. 4 is about 36 lbs. The angles, dimensions, and cylinder force also permit the chair to be moved from the flat position to the chair position when the chair is empty.

As discussed above, the arms 28 can be pivoted relative to the back section 20 to move the arms 28 out of the way for transfer of the resident. Each arm 28 includes a support 160 that is rigidly coupled to a side tube member 46 of head section 20 as shown in FIGS. 5–8. An internal cylinder 162 is coupled to support 160. An actuator bar 164 includes a threaded end 166. A spring 167 extends between a lock nut 168 coupled to bar 164 and a support bar 170 located inside cylinder 162. A handle or lift knob 172 is coupled to a distal end of the bar 164. Cylinder 162 includes a pair of spaced apart notches 174 configured to receive a pair of dowel pins 176 extending away from opposite sides of bar 164.

Arm rest 28 also includes an outer cylinder 178 rotatably mounted on the internal cylinder 162. A washer 179 is located between cylinder 178 and support 160. A support 180 is coupled to cylinder 178. A tube 182 has opposite ends coupled to support 180 to define the arm section 28. A padded portion 184 is located over the tubes 182 and the support 180. Cylinder 178 illustratively includes four spaced apart notches 186 configured to receive the pins 176 on bar 164. Illustratively, pins 176 enter diametrically opposed notches 186 formed in outer cylinder 178 to hold the arm sections 28 in a desired location. Spring 167 holds the pins 176 in seated positions to retain the arms within the notches 186.

Figure 8:
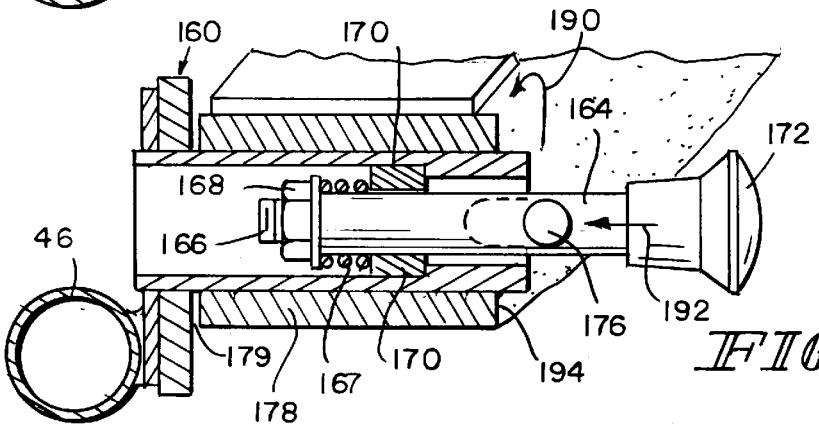

When it is desired to move the arms 28, a caregiver pulls on knob 72 outwardly in the direction of arrow 188 to the position shown in FIG. 8. This releases the pins 176 from notches 186 and allows the cylinder 178 to rotate relative to cylinder 162 as illustrated by double headed arrow 190. When the knob 172 is released, the spring 166 pulls the bar 164 and knob 172 in the direction of arrow 192 in FIG. 8. The pins 176 then either enter the notches 186 or engage an outer surface 194 of cylinder 178 until the next pair of notches 186 are aligned with pins 176. If pins 176 engage the surface 194, then the spring 166 will pull the pins 176 into the next pair of notches 186 to lock the arms 28 in position. It is understood that an increased number of notches 186 may be provided to increase the number of locked positions of the arms 28. In addition, only one pin 176 or pins 176 aligned at different angles may be used, if desired.

Figure 9:
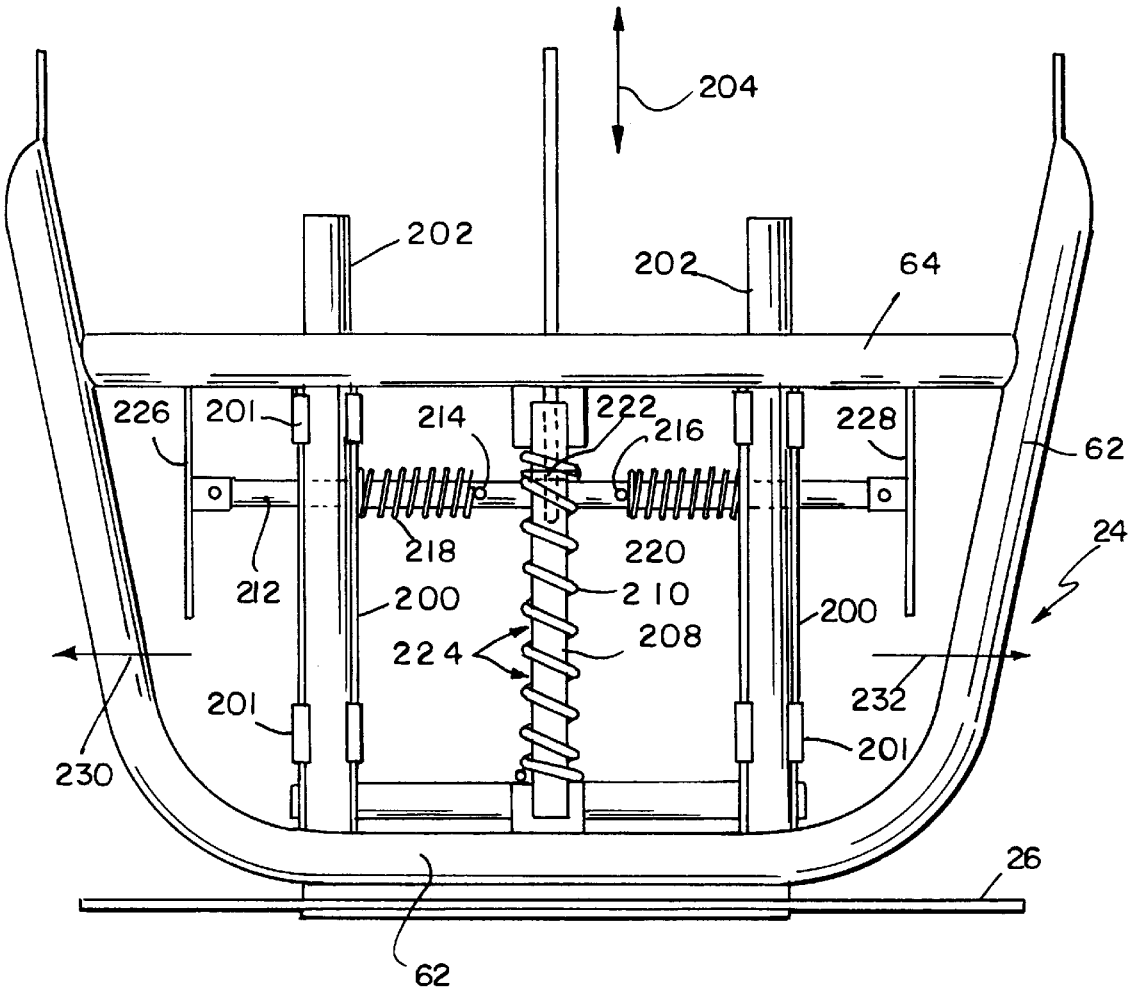
FIG. 9 is a top plan view of a leg section of the chair illustrating an adjustable position foot prop in a raised position located adjacent a bottom frame portion of the leg section.
Figure 10:
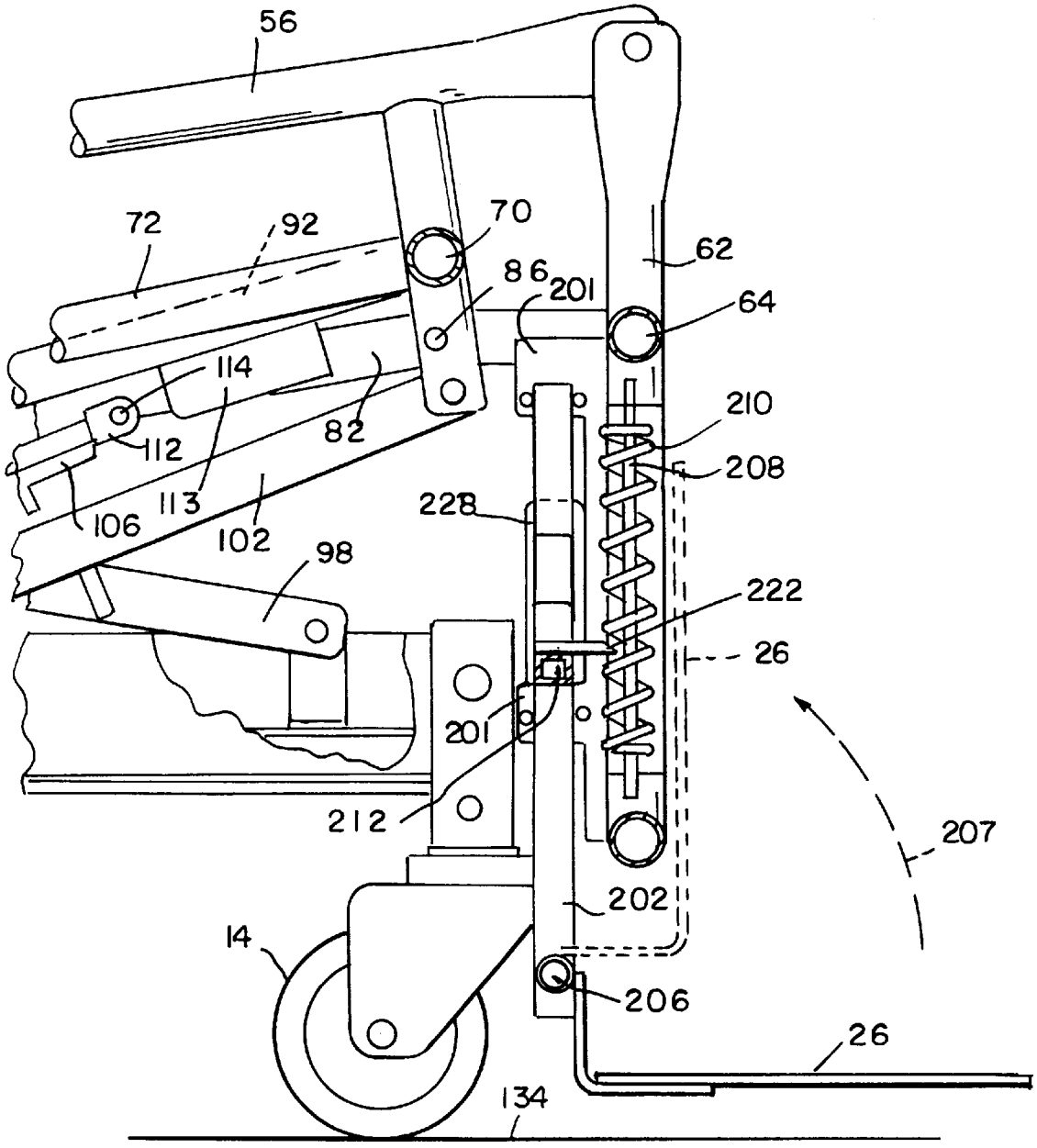
FIG. 10 is a side sectional view of a portion of the chair illustrating the foot prop in a lowered position.

FIGS. 9 and 10 illustrate details of an adjustable foot prop mechanism of the present invention. Leg section 24 includes outer tube support elements 200 coupled between cross tube 64 and a foot end of outer tube 62 as shown in FIG. 9. A pair of spaced apart receptacles 201 are coupled to tube support elements 200 as best illustrated in FIG. 10. Inner telescoping tubes 202 are located within receptacles 201 on tube support elements 200. Tubes 202 are configured to slide back and forth relative to leg section 24 in the directions of double headed arrow 204. Foot prop 26 is pivotably coupled to a tube 206 extending between the first and second telescoping tubes 202 as best shown in FIG. 10. Therefore, foot prop 26 can pivot from a downwardly extended support position shown in FIG. 10 to an upwardly pivoted storage position in the direction of arrow 207. In the storage position, the foot prop 26 is positioned to lie substantially parallel to the leg support section 24 as illustrated in the dotted position of FIG. 10.

A position member comprising a support 208 (coupled between cross tube 64 and the foot end of outer tube 62 of leg section 24) and helical spring 210 (located over the support 208) is shown in FIG. 9. A helical spring 210 is located over the support 208. A control tube 212 is slidably coupled between tubes 202. Tube 212 includes first and, second stops 214 and 216. Springs 218 and 220 are located over tube 212 between tube support elements 200 and stops 214 and 216, respectively. A center stop 222 is also mounted on tube 212. Center stop 222 is configured to enter openings 224 formed by spring 210. First and second handles 226 and 228 are mounted to opposite ends of control tube 212.

When handle 226 is pulled in the direction of arrow 230, spring 218 is compressed to move stop 222 away from the gaps 224 of spring 210. Therefore, the tubes 202, control tube 212, and foot prop 26 can move relative to the leg section 24 in the directions of double headed arrow 204 to adjust the position of the foot prop 26. When handle 228 is pulled outwardly in the direction of arrow 232, spring 220 is compressed to move stop 222 and also permit movement of the tubes 202, control tube 212 and foot prop 26 in the direction of double headed arrow 204. In other words, the movable foot prop 26 can be released for movement from either side of the leg section 24.

It is understood that different types of actuators can be coupled to tube 212 so that a caregiver can push on the actuator to release the foot prop 26, instead of pulling on the handles. Springs 218 and 220 are balanced so that the stop 222 is centered in one of the notches 224 of spring 210 to hold the foot prop 26 in a desired location when handle 226 or 228 is released. It is understood that another type of notched support may be used to position the foot prop 26 in incremental position.; relative to the leg section 24. However, spring 210 provides an inexpensive and reliable stop mechanism for positioning the foot prop 26. FIG. 9 illustrates the foot prop 26 in a raised position next to the foot end tube 62 of leg section 24. FIG. 10 illustrates the foot prop 26 in a lowered position closer to the floor 134.

Figure 11:
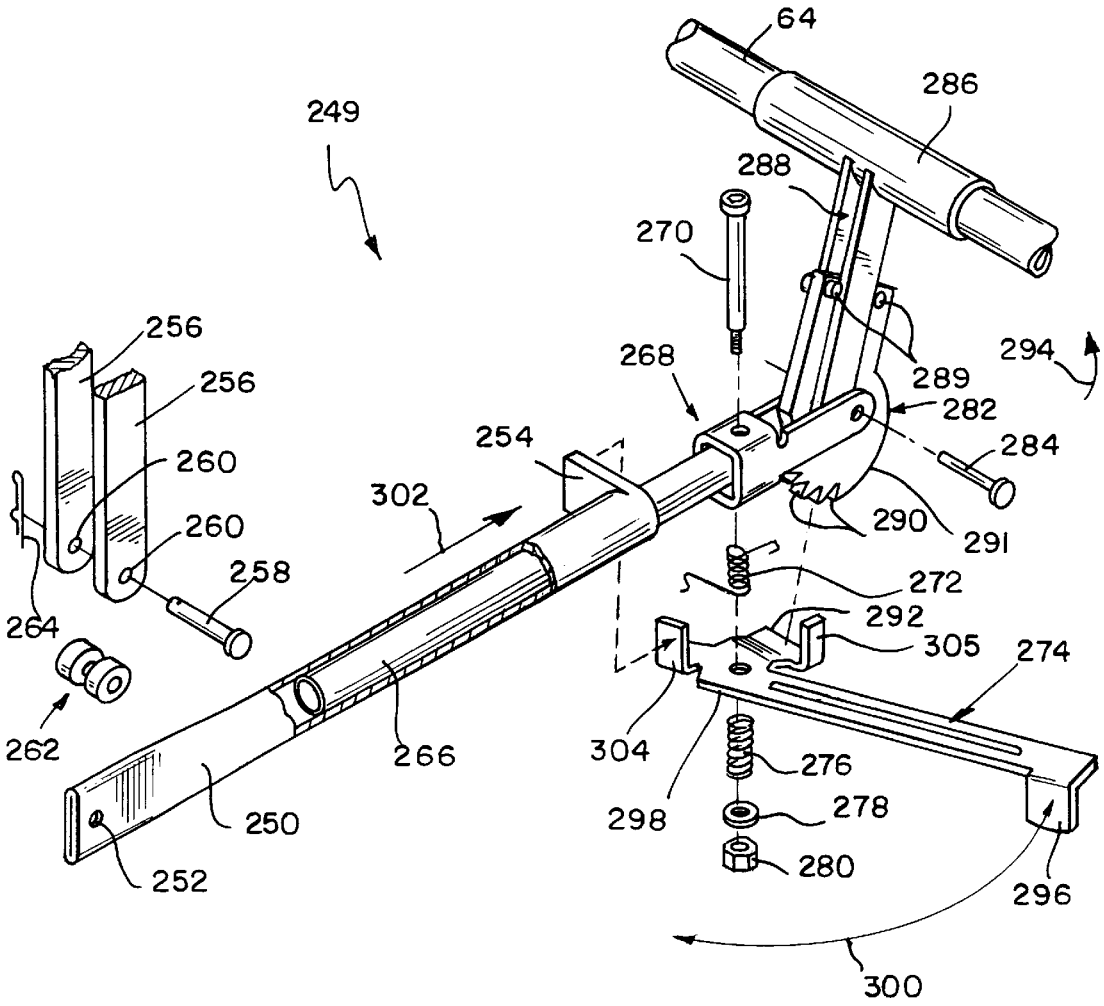
FIG. 11 is a perspective view of a leg tilt lock assembly for adjusting an angular position of the leg section of the chair.

FIG. 11 illustrates details of a lock assembly 249 for a leg tilt apparatus which controls the angular position of leg section 24 relative to seat section 22. The lock assembly 249 includes an outer tube 250 formed to include an aperture 252, at one end and a strike plate 254 at an opposite end. A pair of spaced apart links 256 sire coupled to the seat section 22. Links 256 are also pivotably coupled to outer tube 250 by a pin 258 which extends through holes 260 of links 256 and through aperture 252 of tube 250. Spacers 262 are located on opposite sides of tube 250. A locking clip 264 is used to secure the pin 258 to the linkage.

An extension tube 266 is slidably received within tube 250. A clevis connector 268 is coupled to an end of tube 266 by a bolt 270. A torsion spring 272, a lever 274, a compression spring 276, a washer 278, and a nut 280 are also coupled to the bolt 270. A latch 282 is pivotably coupled to connector 268 by a pin 284. A leg clip 286 is rigidly coupled to the cross bar 64 of leg section 24. Leg clip 286 includes a pair of links 288 coupled to latch 282 and connector 268 by pin 284. Stops 289 keep the links 288 from moving relative to the latch 282.

Latch 282 includes a plurality of notched sections or teeth 290 along a circumferential edge 291. Teeth 290 are configured to engage an edge 292 of lever 274. When leg section 24 is pivoted upwardly in the direction of arrow 294, a different tooth 290 engages edge 292 of lever to hold the leg section 24 in an elevated position. The edge 292 and teeth 290 therefore provide a ratchet mechanism for holding the leg support section 24 at different elevations relative to the seat section 22.

Lever 274 also includes a tab 296. A caregiver can use the tab 296 to rotate the lever 274 about axis 298 in the direction of arrow 300 to move the edge 292 away from the teeth 290. Therefore, the leg section 24 will move back downwardly to the lowered position illustrated in FIG. 2 due to gravity when the teeth 290 are disengaged. In addition, when the chair 10 is moved to the flat position shown in FIG. 4, tube 250 slides toward the lever 274 in the direction of arrow 302. Plate 254 engages a tab 304 of lever 274 to rotate the lever 274 in the direction of arrow 300 as the chair 10 moves to the flat position. This movement of the lever 279 releases the edge 292 from engagement with the teeth 290. Therefore, after the chair 10 is moved to the flat position shown in FIG. 4, the leg section 29 will automatically return to its position shown in FIG. 2 when the chair 10 is returned to the chair position. The caregiver must then elevate the leg section 24 again manually until the edge 292 engages an appropriate teeth 290 if it is desired to raise the leg section 24. Torsion spring 272 causes edge 292 to be aligned with teeth 290 after the lever 274 is released. Tab 305 limits movement of the lever 274.

Although the invention has been described in detail with reference to at certain illustrated embodiment, variations and modifications exist within the scope and spirit of the invention as described and as defined in the following claims.

What is claimed is:

1. An adjustable foot prop apparatus for adjustable movement with respect to a leg section of a chair, the apparatus comprises:

a positioning member coupled to the leg section, the positioning member including a plurality of spaced apart stops;

a foot prop support movably coupled to the leg section;

a foot prop coupled to the foot prop support; and a stop element coupled to the foot prop support for sliding movement with respect to the foot prop support to provide selective engagement with respective ones of the plurality of spaced apart stops of the positioning member.

2. The apparatus of claim 1, wherein the plurality of spaced apart stops of the positioning member are arranged in a substantially linear array.

3. The apparatus of claim 1, wherein the positioning member comprises a support and the plurality of spaced apart stops comprise adjacent coils of a spring element which is positioned over the support.

4. The apparatus of claim 1, wherein the stop element is coupled to the foot prop support so as to be linearly moveable with respect thereto.

5. The apparatus of claim 4, wherein the stop element extends from an elongate member which is movable with respect to the foot prop support.

6. The apparatus of claim 1, wherein the stop element is biased to engage the plurality of spaced apart stops of the positioning member.

7. The apparatus of claim 5, wherein the stop element is biased to engage the plurality of spaced apart stops of the positioning member.

8. The apparatus of claim 1, wherein the foot prop support comprises two parallel elongate members which are movably coupled to the leg section.

9. The apparatus of claim 8, wherein the two parallel elongate members of the foot prop support are parallel to the positioning member.

10. The apparatus of claim 9 wherein the two parallel elongate members of the foot prop are parallelly movable with respect to the positioning member.

11. The apparatus of claim 1, wherein the foot prop is pivotally coupled to the foot prop support.

12. An apparatus for adjusting the length of a foot prop of a chair having a leg section the apparatus comprising:

a foot prop support slidingy coupled to the leg section for adjustable slideable extended movement therefrom;

a foot prop coupled to an end of the foot prop support;

a positioning member coupled to the leg section and including at least three spaced apart stops; and a stop element movably coupled to the foot prop support for selective engagement with respective ones of the at least three spaced apart stops of the positioning member.

13. An adjustable foot prop apparatus for a leg section of a chair, the apparatus comprising:

a positioning member coupled to the leg section, the positioning member being configured to define a plurality of spaced apart stops;

a support element movably coupled to the leg section;

a foot prop coupled to the support element;

a control tube coupled to the support element, the control tube having a stop configured to engage one of the plurality of stops on the positioning member;

an actuator configured to permit movement of the control tube and the stop on the control tube away from the stops on the positioning member so that the support and the foot prop can move relative to the leg section; and at least one spring configured to bias the control tube toward the positioning member so that the stop on the control tube engages one of the stops of the positioning member when the actuator is released.

14. The apparatus of claim 13, wherein the positioning member includes a support member coupled to the leg section and a spring located on the support member, the spring being configured to define the plurality of spaced apart stops.

15. The apparatus of claim 13, wherein the support element includes a fixed support having a receptacle coupled to the leg section of the chair and the movable support element is moveably located in the receptacle, the foot prop being coupled to the movable support element.

16. The apparatus of claim 15, wherein the fixed support includes first and second spaced apart receptacles, and the control tube is coupled to the movable support element at a location between the first and second receptacles so that the control tube element is configured to engage the receptacles and limit movement of the movable support element relative to the leg section.

17. The apparatus of claim 15, wherein the fixed support includes first and second fixed supports coupled to the leg section, each of the fixed supports having first and second spaced apart receptacles, the fixed support also including first and second movable support elements located within the receptacles of the first and second fixed supports, respectively, the foot prop being coupled to the first and second movable support elements.

18. The apparatus of claim 17, wherein the control tube is slidably coupled to the first and second movable support elements, and wherein a first spring is coupled to the control tube and configured to engage the first movable support element and a second spring being coupled to the control tube and configured to engage the second movable support element to bias the control tube so that the stop on the control tube normally engages one of the plurality of stops on the positioning member.

19. The apparatus of claim 18, wherein first and second actuators are coupled to opposite ends of the control tube so that the control tube can be moved to release the stop on the control tube from the plurality of stops on the positioning member from either side of the leg section.

20. The apparatus of claim 13, wherein the foot prop is pivotably coupled to the support element.

* * * * *